US011557871B2

(12) United States Patent
Yamanashi

(10) Patent No.: US 11,557,871 B2
(45) Date of Patent: Jan. 17, 2023

(54) CONNECTOR MANUFACTURING METHOD AND CONNECTOR

(71) Applicant: Yazaki Corporation, Tokyo (JP)

(72) Inventor: Daisuke Yamanashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/350,255

(22) Filed: Jun. 17, 2021

(65) Prior Publication Data

US 2021/0399511 A1 Dec. 23, 2021

(30) Foreign Application Priority Data

Jun. 23, 2020 (JP) ..... JP2020-107781

(51) Int. Cl.
*H01R 13/52* (2006.01)
*H01R 43/00* (2006.01)

(52) U.S. Cl.
CPC ..... *H01R 43/007* (2013.01); *H01R 13/5205* (2013.01)

(58) Field of Classification Search
CPC .. H01R 13/5202; H01R 2201/26; H01R 4/34; H01R 13/521; H01R 13/5219; H01R 11/12; H01R 13/5208; H01R 13/648; H01R 9/24; H01R 13/516; H01R 2103/00; H01R 13/504; H01R 13/74; H01R 13/4223; H01R 13/6593; H01R 13/405; H01R 13/65912; H01R 13/6592; H01R 13/502; H01R 13/6215; H01R 43/24; H01R 13/512; H01R 13/5221; H01R 13/6581; H01R 2105/00; H01R 13/506; H01R 13/52; H01R 43/007–13/5205
See application file for complete search history.

(56) References Cited

U.S. PATENT DOCUMENTS 9,017,099 B2 * 4/2015 Ikeda ..... H01R 13/521 439/559
9,484,647 B2 * 11/2016 Ishikawa ..... H01R 9/24
9,570,899 B2 * 2/2017 Tanaka ..... H02G 15/013
2014/0024239 A1 1/2014 Tanaka et al.
2014/0322973 A1 10/2014 Okamoto et al.

FOREIGN PATENT DOCUMENTS

JP 2012-243636 A 12/2012

* cited by examiner

*Primary Examiner* — Vanessa Girardi
(74) *Attorney, Agent, or Firm* — Sughrue Mion, PLLC

(57) ABSTRACT

A connector manufacturing method includes: a first insertion process of inserting a conductor held by a housing through an annular seal member; a second insertion process of inserting the conductor through an annular portion of a support member; a pushing-in process of pushing the seal member into a gap between an inner circumferential surface of a recess in the housing and the conductor by pressing the seal member using the annular portion; and an engagement process of making the annular portion support the seal member at a predetermined position by engaging the support member and the housing, wherein the predetermined position is a position before a bottom portion of the recess.

3 Claims, 20 Drawing Sheets

CONNECTOR MANUFACTURING METHOD AND CONNECTOR

CROSS-REFERENCE TO RELATED APPLICATION(S)

The present application claims priority to and incorporates by reference the entire contents of Japanese Patent Application No. 2020-107781 filed in Japan on Jun. 23, 2020.

BACKGROUND OF THE INVENTION

1. Field of the Invention

The present invention relates to a connector manufacturing method and a connector.

2. Description of the Related Art

Conventionally, there has been a connector including a seal member. Japanese Patent Application Laid-open No. 2012-243636 discloses a connector including a housing having a terminal insertion hole, a terminal inserted into the terminal insertion hole, an O-ring attached to surround an entire circumference of the terminal to fill a gap between the terminal insertion hole and the terminal, and an O-ring holder pressed toward the O-ring by a fastening nut to push the O-ring toward the gap between the terminal insertion hole and the terminal.

It is desired to position a seal member at an appropriate position. For example, if the seal member is pushed-in too deep, the seal member may be deformed, etc., resulting in a decrease in seal performance.

SUMMARY OF THE INVENTION

An object of the present invention is to provide a connector manufacturing method and a connector capable of positioning a seal member at an appropriate position.

In order to achieve the above mentioned object, a connector manufacturing method according to one aspect of the present invention includes a first insertion process of inserting a conductor held by a housing through an annular seal member; a second insertion process of inserting the conductor through an annular portion of a support member; a pushing-in process of pushing the seal member into a gap between an inner circumferential surface of a recess in the housing and the conductor by pressing the seal member using the annular portion; and an engagement process of making the annular portion support the seal member at a predetermined position by engaging the support member and the housing, wherein the predetermined position is a position before a bottom portion of the recess.

According to another aspect of the present invention, in the connector manufacturing method, it is preferable that the annular portion has a shape allowing insertion thereof into the gap, and in the pushing-in process, the annular portion is inserted into the gap.

According to still another aspect of the present invention, in the connector manufacturing method, it is preferable that the connector manufacturing method further includes a process of placing a nut on the support member, wherein in the pushing-in process, the seal member is pushed-in by the support member supporting the nut, and the nut is fixed to the housing by the engagement process.

In order to achieve the above mentioned object, a connector according to still another aspect of the present invention includes a conductor; a housing holding the conductor and having a recess surrounding the conductor; an annular seal member sealing a gap between an inner circumferential surface of the recess and the conductor; and a support member having an annular portion positioned on an inlet side of the recess with respect to the seal member, and engaged with the housing in a state where the seal member is supported by the annular portion, wherein the seal member is supported by the annular portion at a position before a bottom portion of the recess.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector manufacturing method and a connector according to an embodiment of the present invention will be described in detail with reference to the drawings. It should be noted that the present invention is not limited by the embodiment. In addition, components in the following embodiment include components that can be easily assumed by those skilled in the art or components that are substantially identical thereto.

EMBODIMENT

Figure 1:
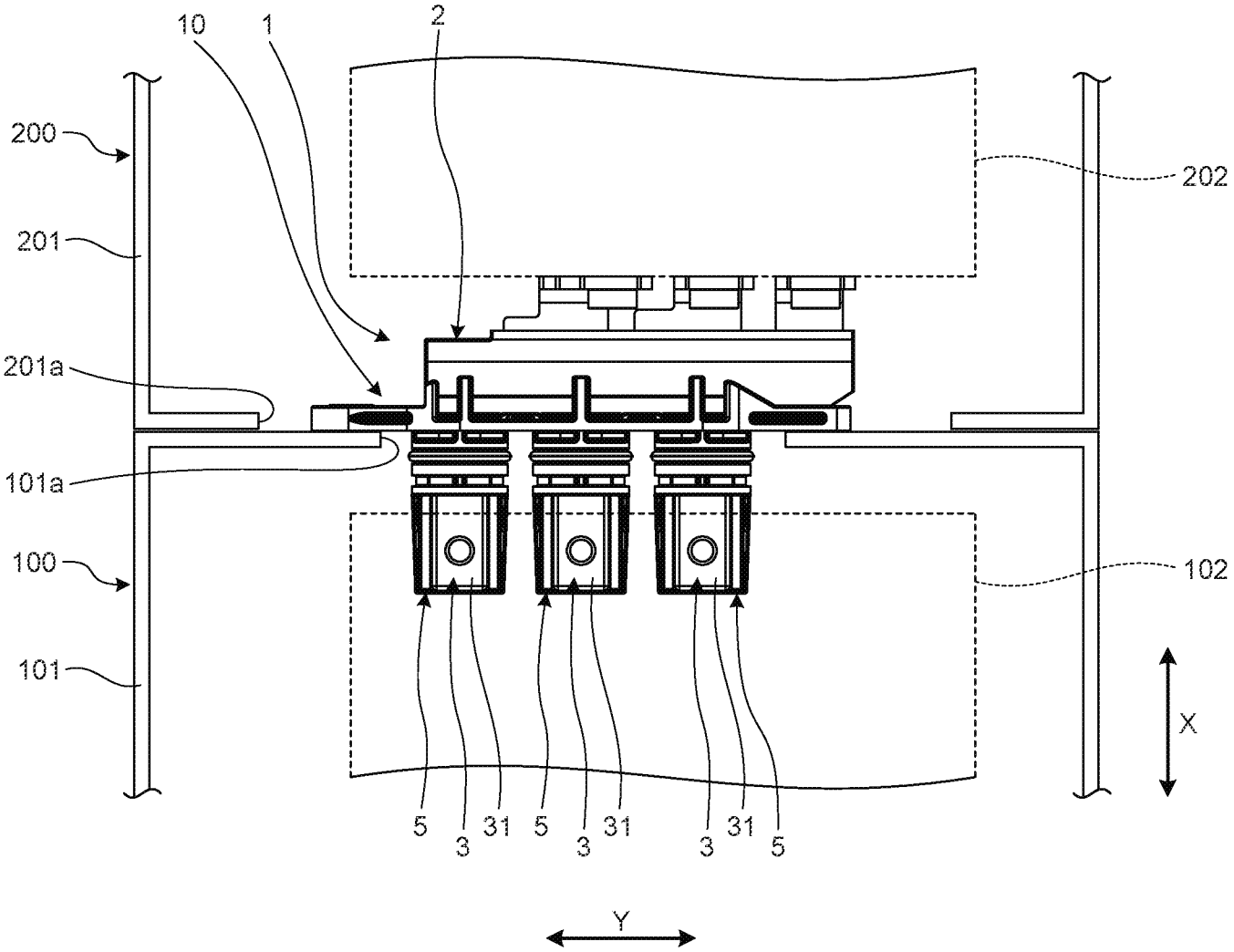
FIG. 1 is a view illustrating an arrangement example of a connector according to an embodiment.
Figure 2:
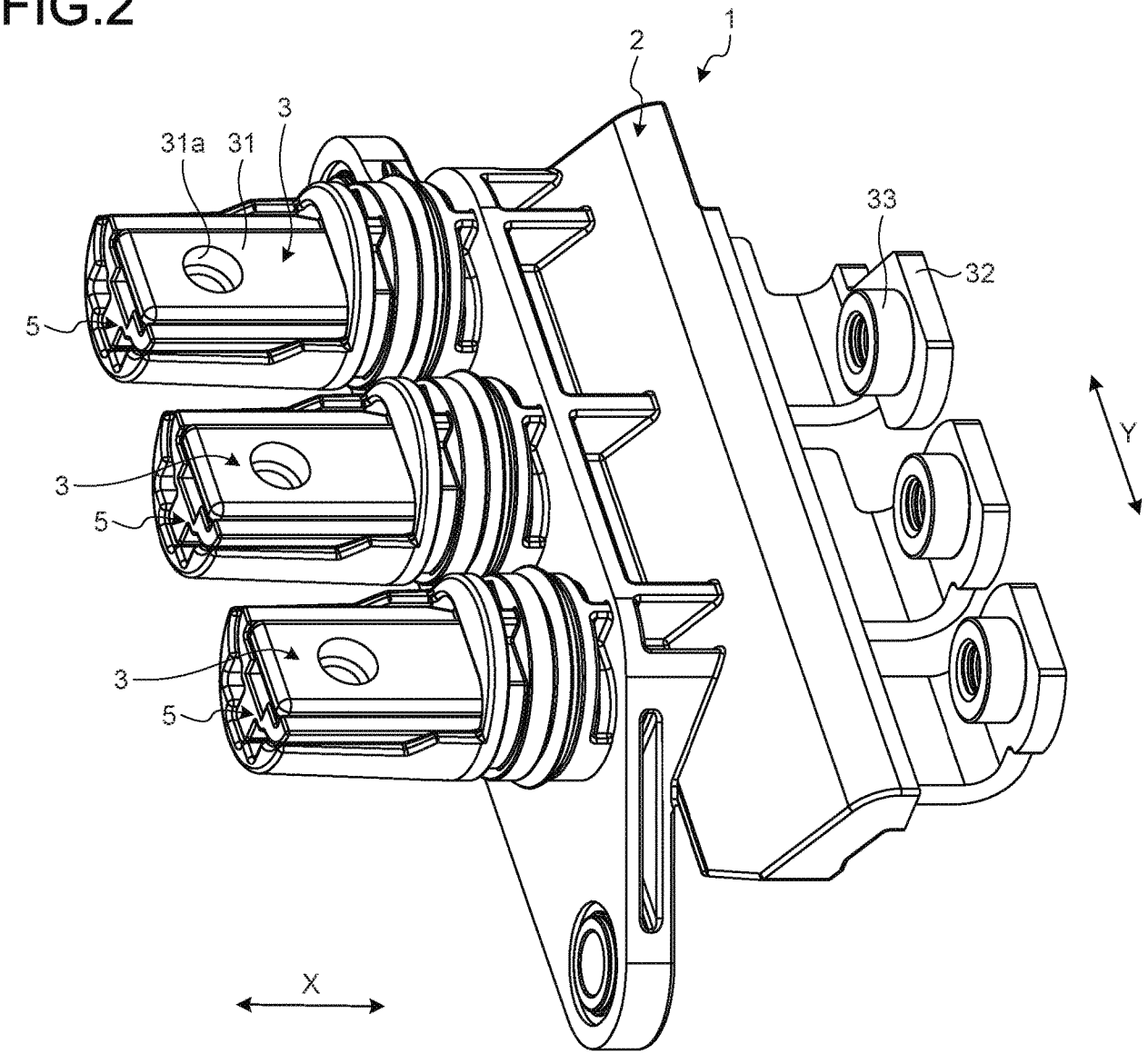
FIG. 2 is a perspective view of the connector according to the embodiment.
Figure 3:
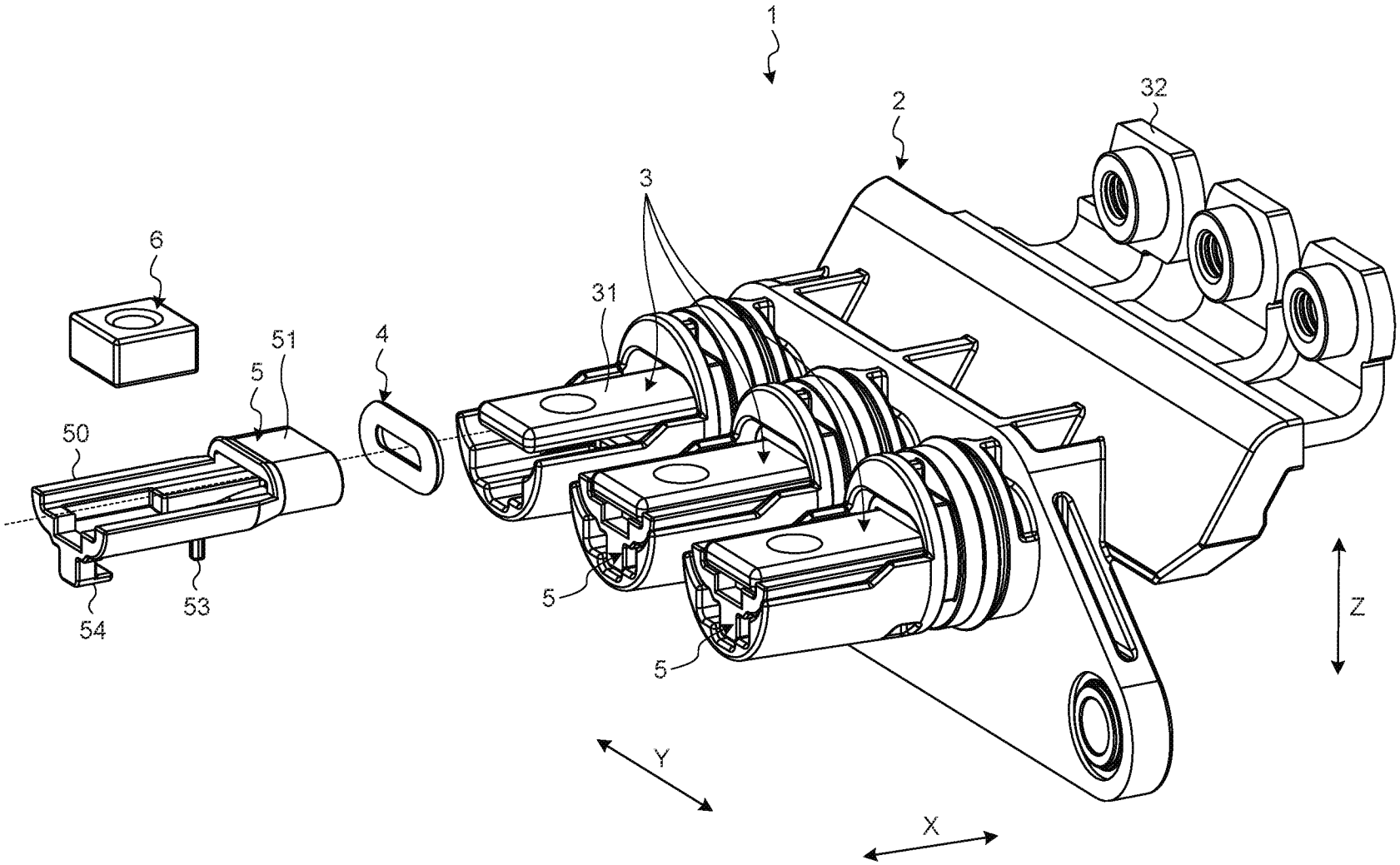
FIG. 3 is an exploded perspective view of the connector according to the embodiment.
Figure 4:
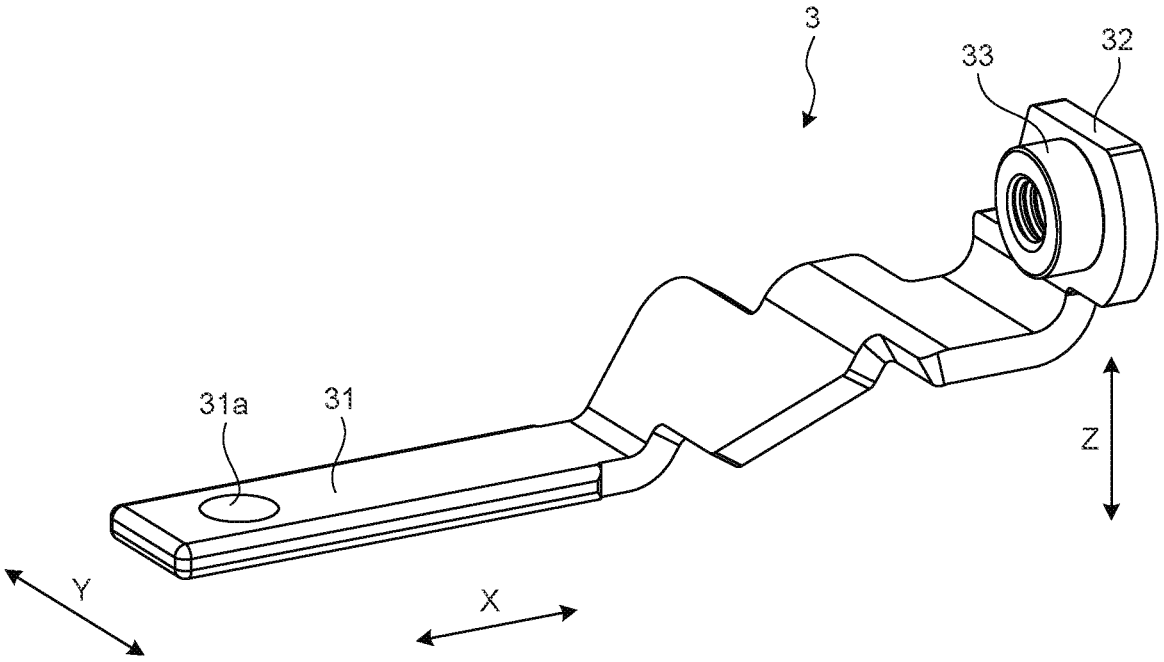
FIG. 4 is a perspective view of a conductor according to the embodiment.
Figure 7:
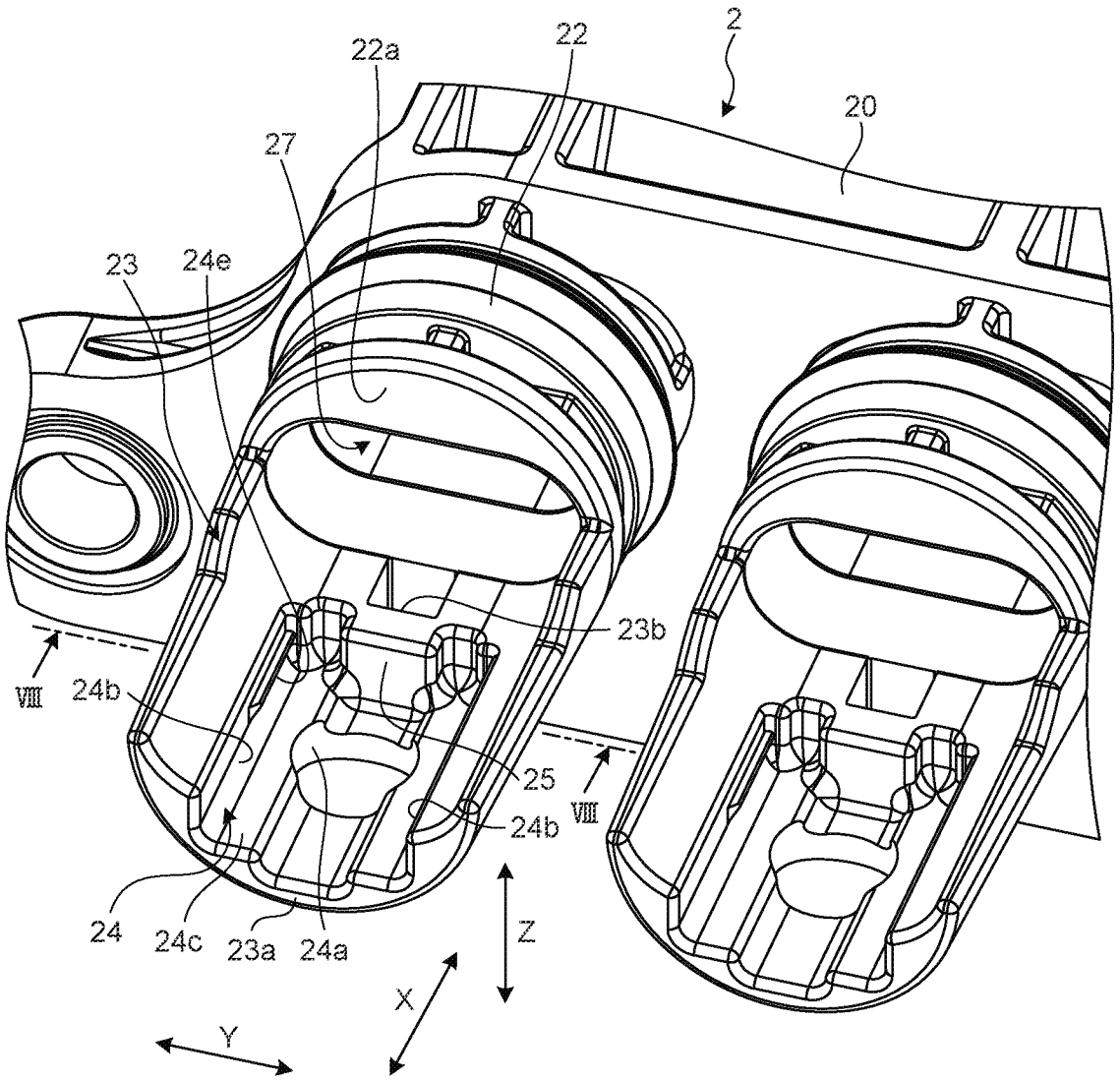
FIG. 7 is a perspective view of the housing according to the embodiment.
Figure 8:
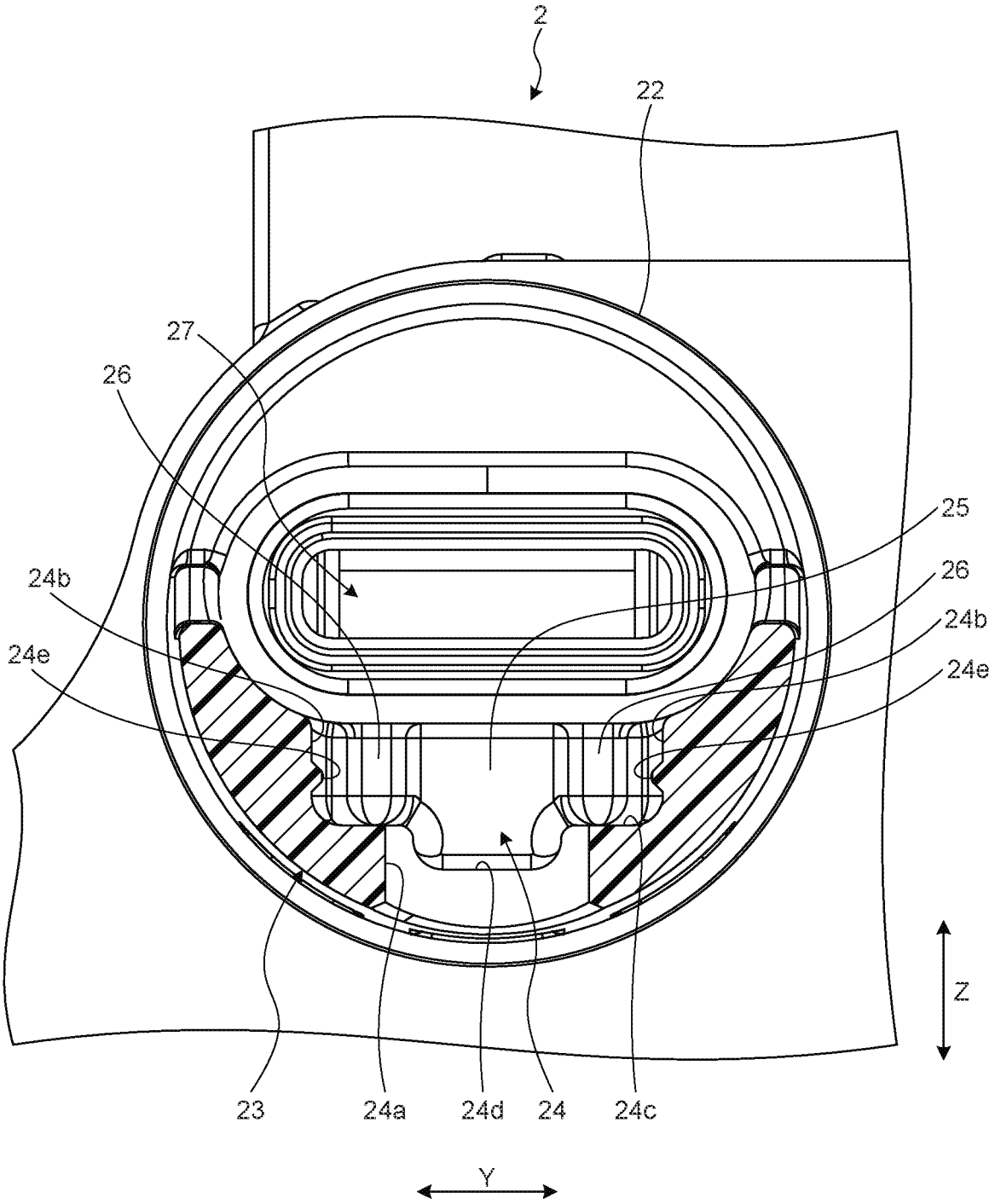
FIG. 8 is a cross-sectional view of the housing according to the embodiment.
Figure 9:
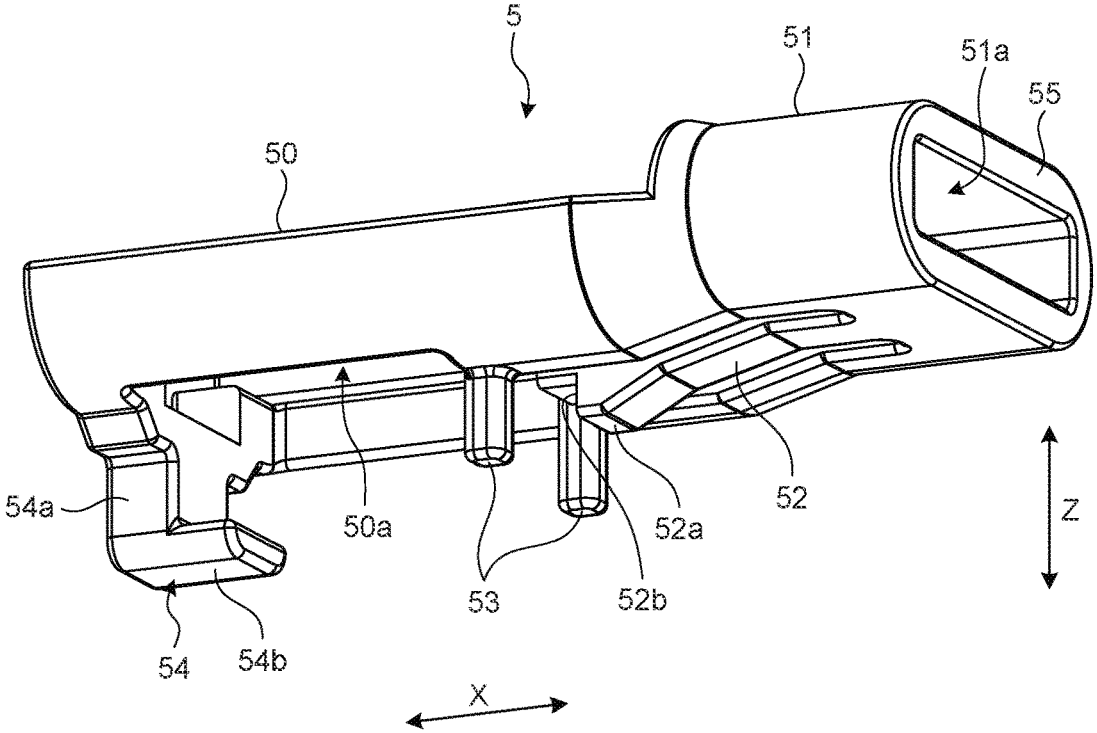
FIG. 9 is a perspective view of a support member according to the embodiment.
Figure 10:
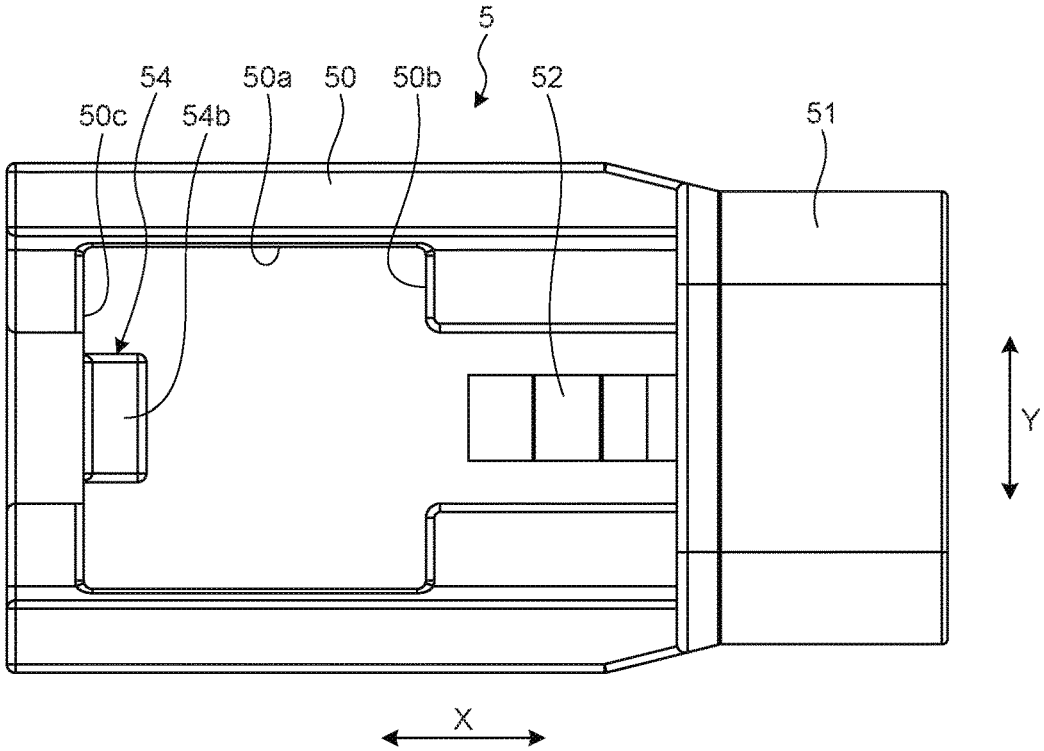
FIG. 10 is a plan view of the support member according to the embodiment.

An embodiment will be described with reference to FIGS. 1 to 21. The present embodiment relates to a connector. FIG. 1 is a view illustrating an arrangement example of a connector according to the embodiment, FIG. 2 is a perspective view of the connector according to the embodiment, FIG. 3 is an exploded perspective view of the connector according to the embodiment, FIG. 4 is a perspective view of a conductor according to the embodiment, FIG. 5 is a plan view of a housing and the conductor according to the embodiment, FIG. 6 is a cross-sectional view of the housing and the conductor according to the embodiment, FIG. 7 is a perspective view of the housing according to the embodiment, FIG. 8 is a cross-sectional view of the housing according to the embodiment, FIG. 9 is a perspective view of a support member according to the embodiment, and FIG. 10 is a plan view of the support member according to the embodiment.

Figure 11:
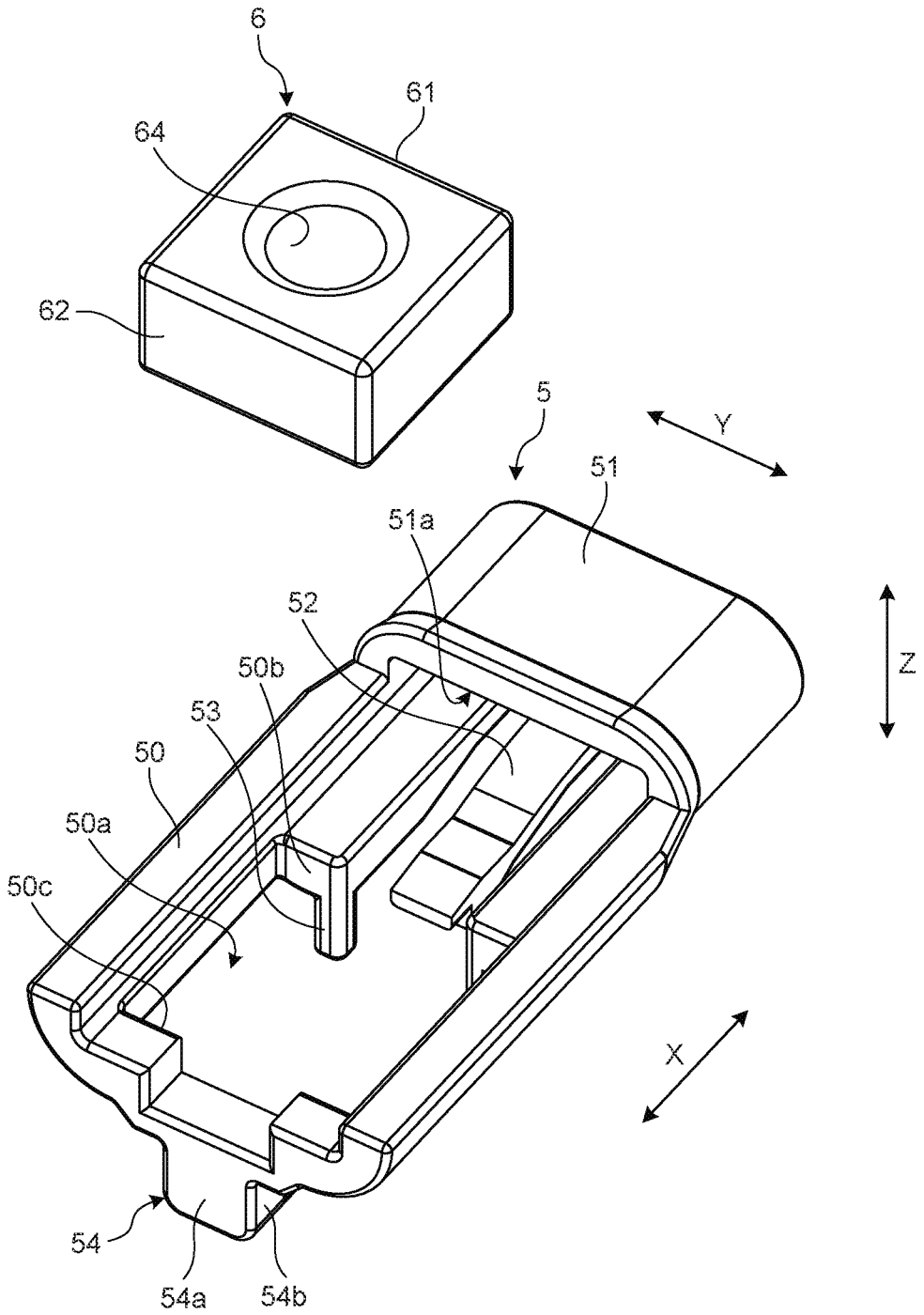
FIG. 11 is a perspective view of the support member and a nut according to the embodiment.
Figure 12:
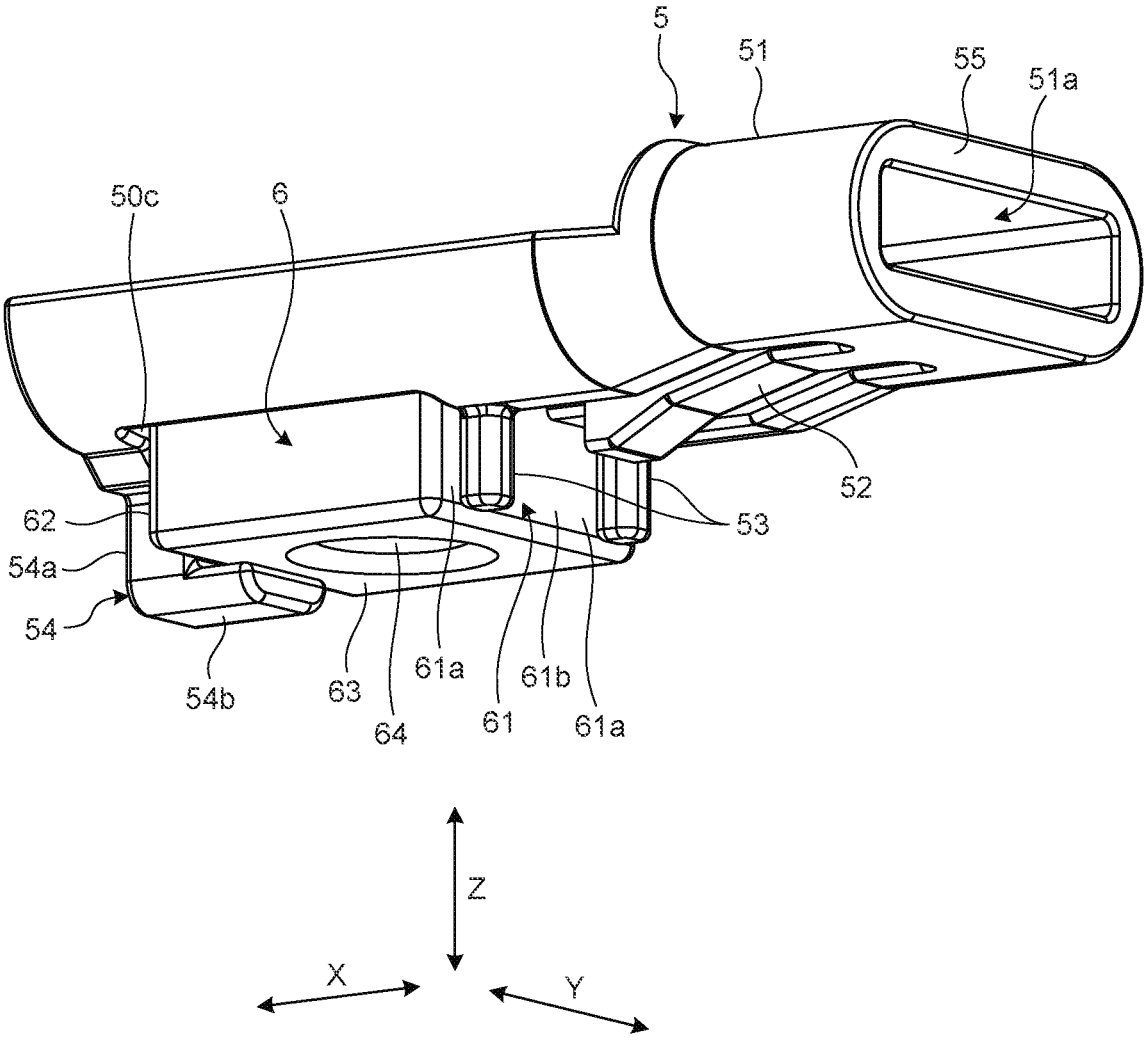
FIG. 12 is a perspective view of the support member and the nut according to the embodiment.
Figure 13:
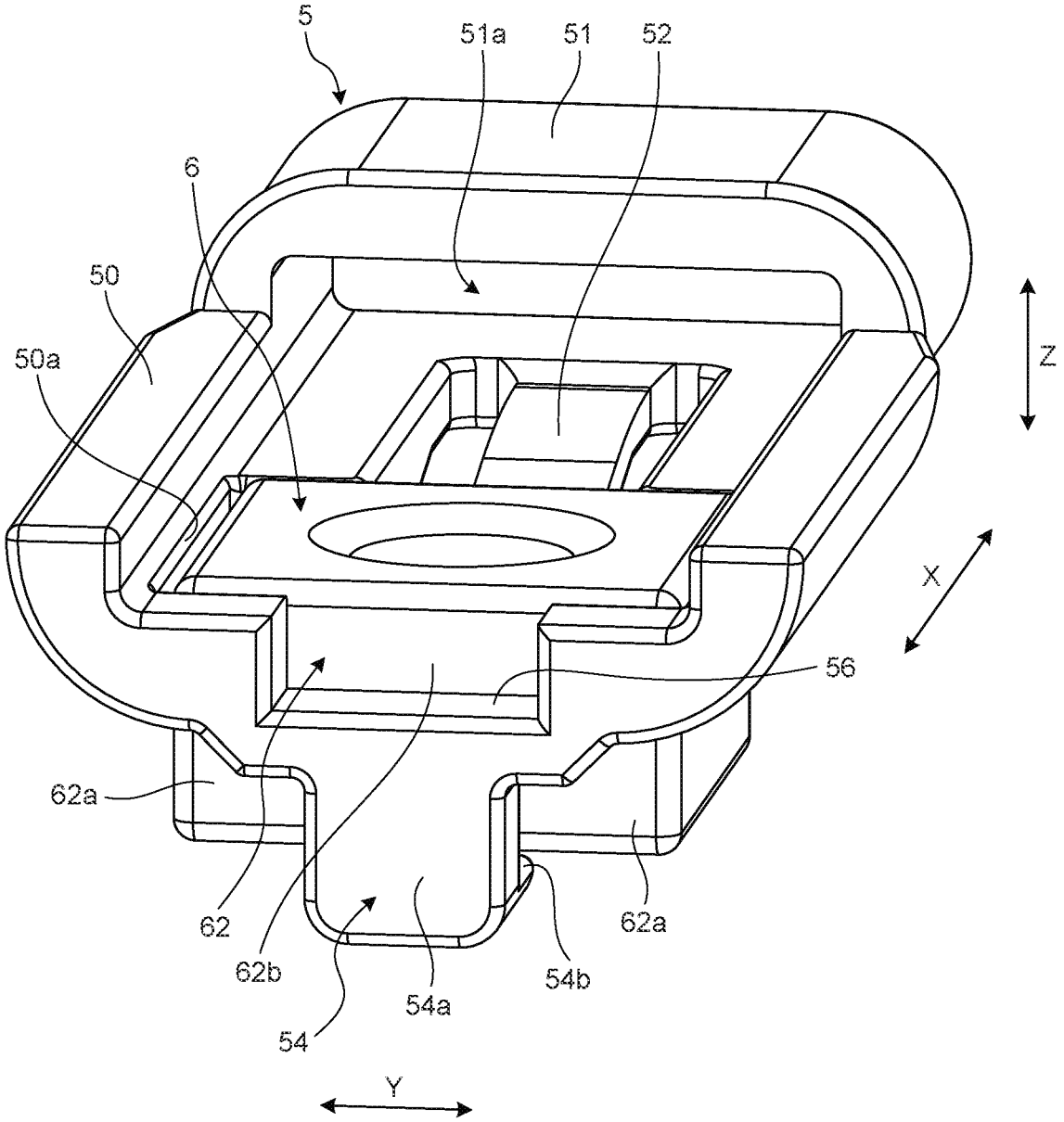
FIG. 13 is a perspective view of the support member and the nut according to the embodiment.
Figure 14:
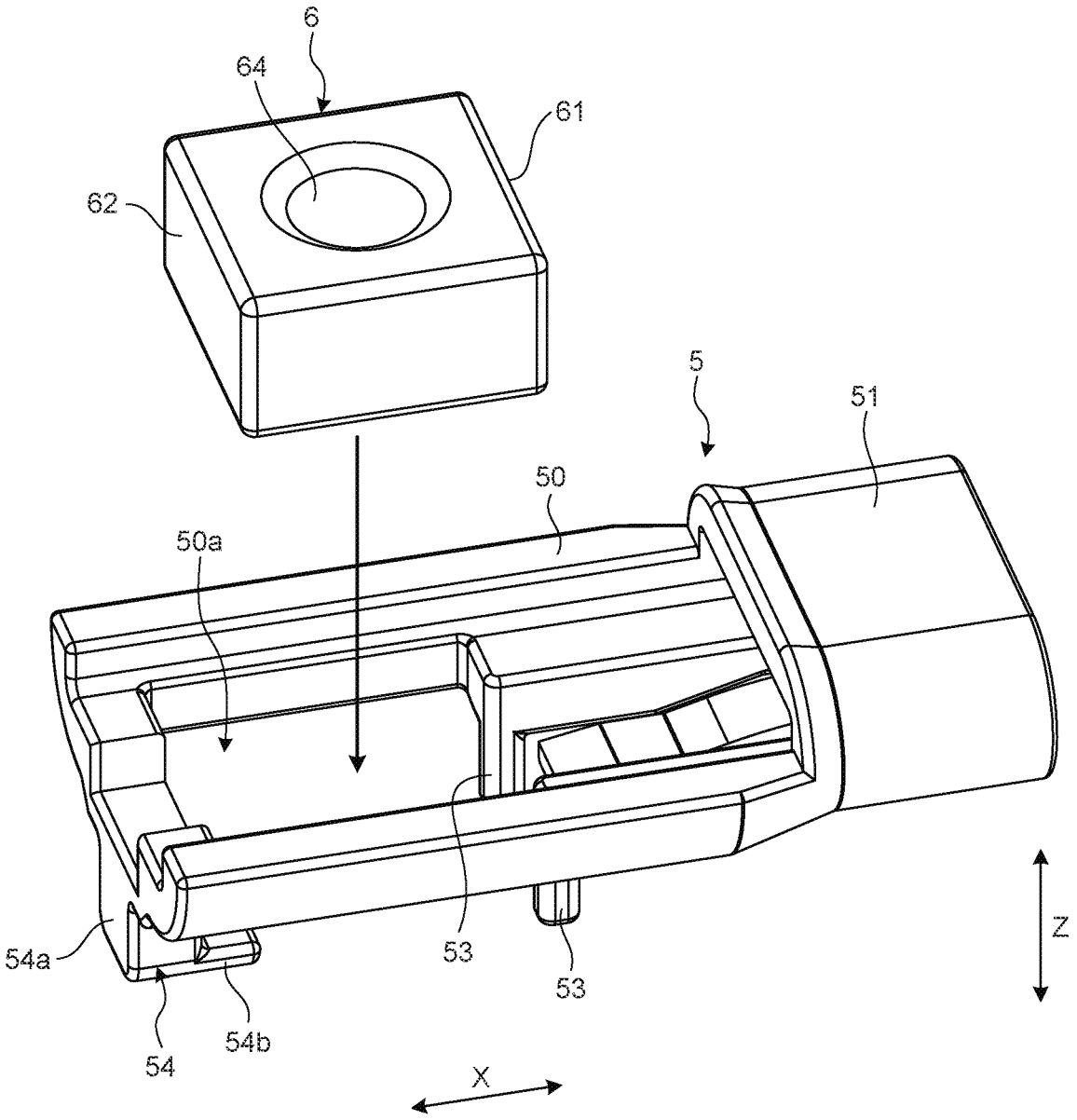
FIG. 14 is a perspective view relating to a process of placing the nut.
Figure 15:
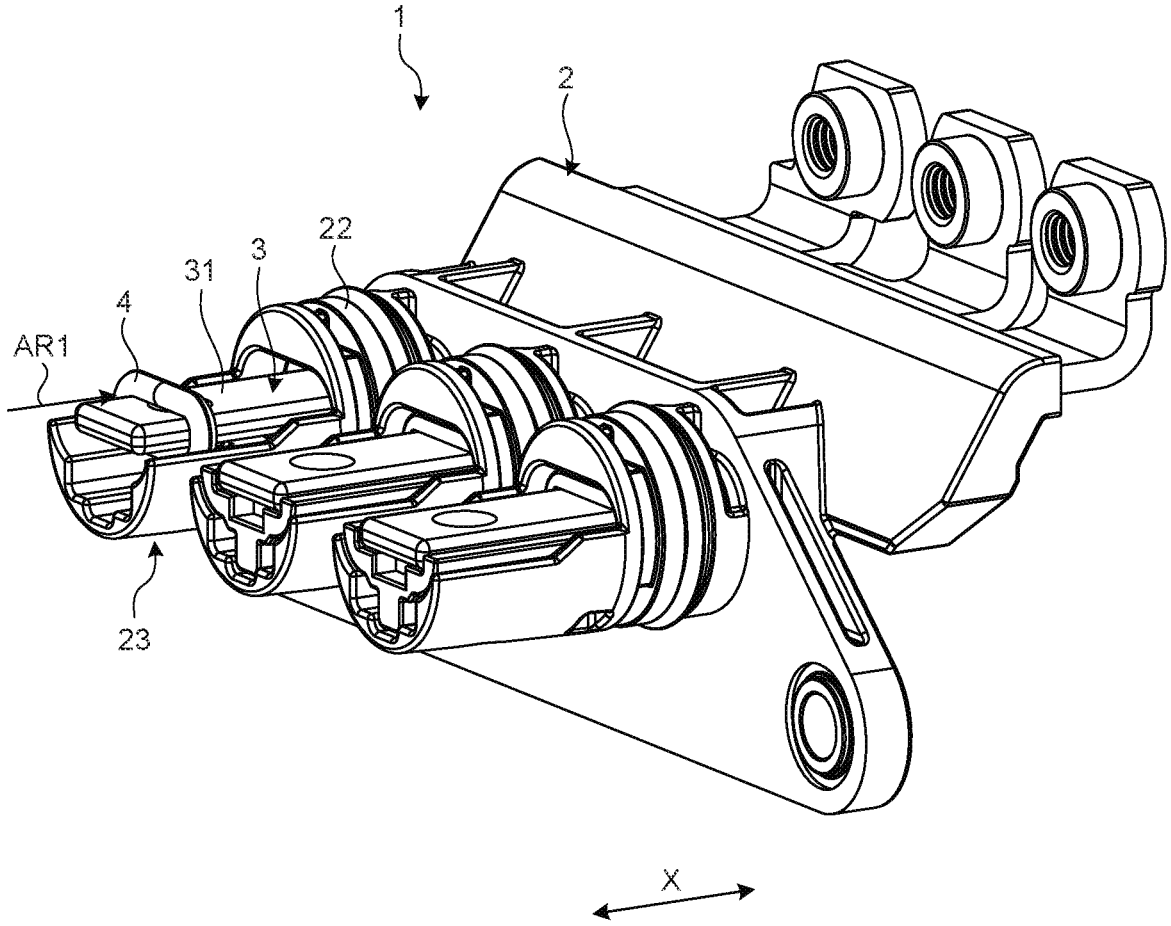
FIG. 15 is a perspective view relating to a first insertion process.
Figure 16:
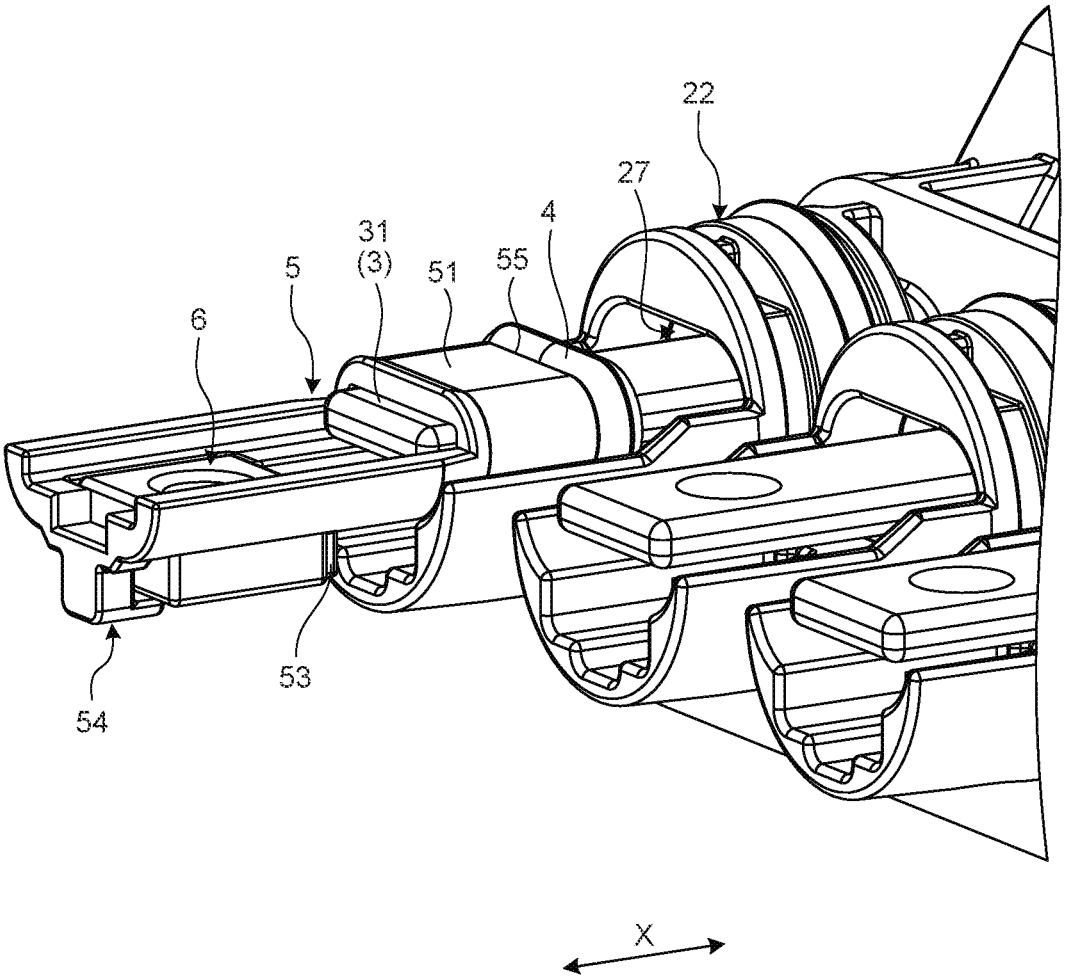
FIG. 16 is a perspective view relating to a second insertion process.
Figure 17:
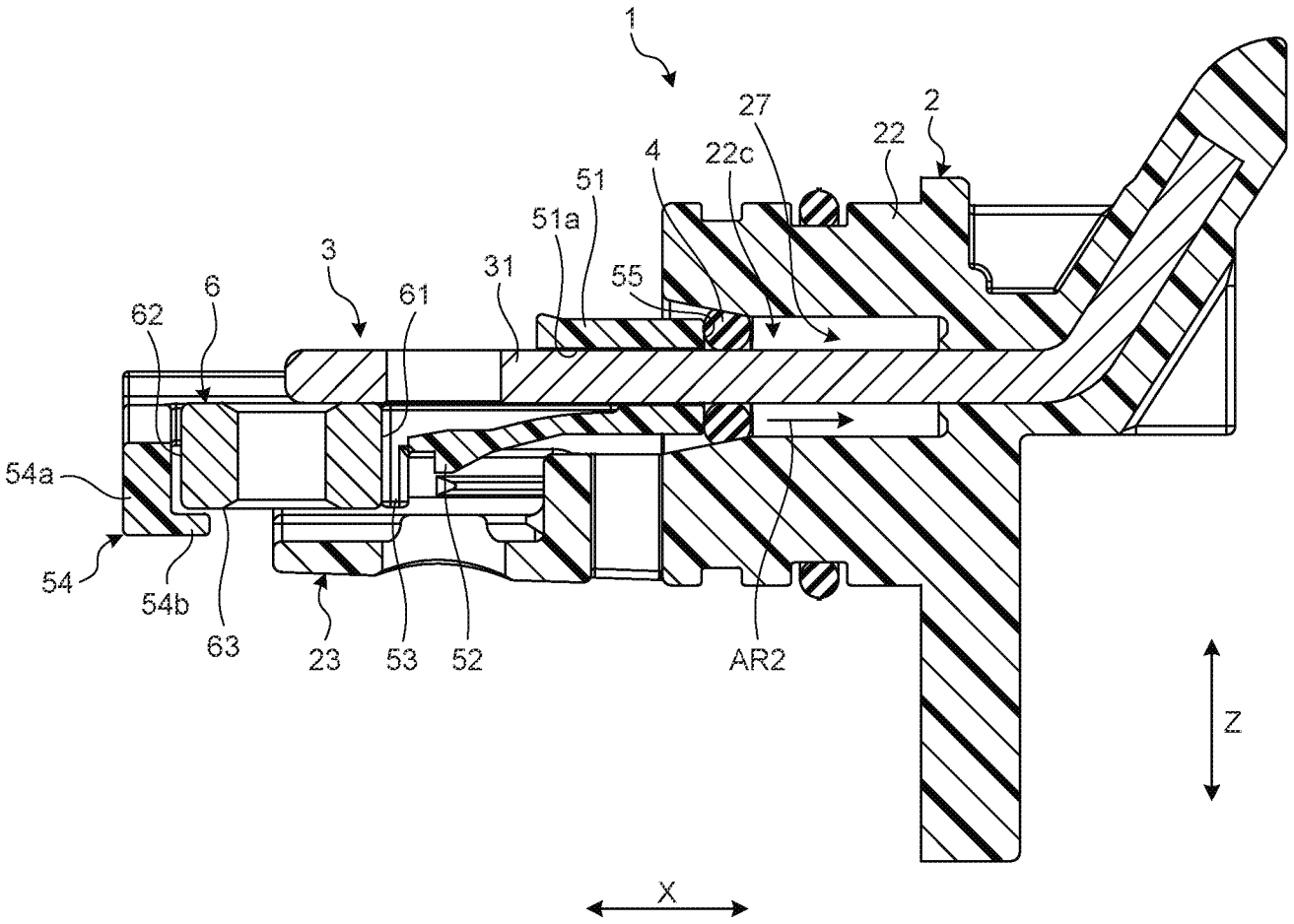
FIG. 17 is a cross-sectional view relating to a process of pushing-in a seal member.
Figure 18:
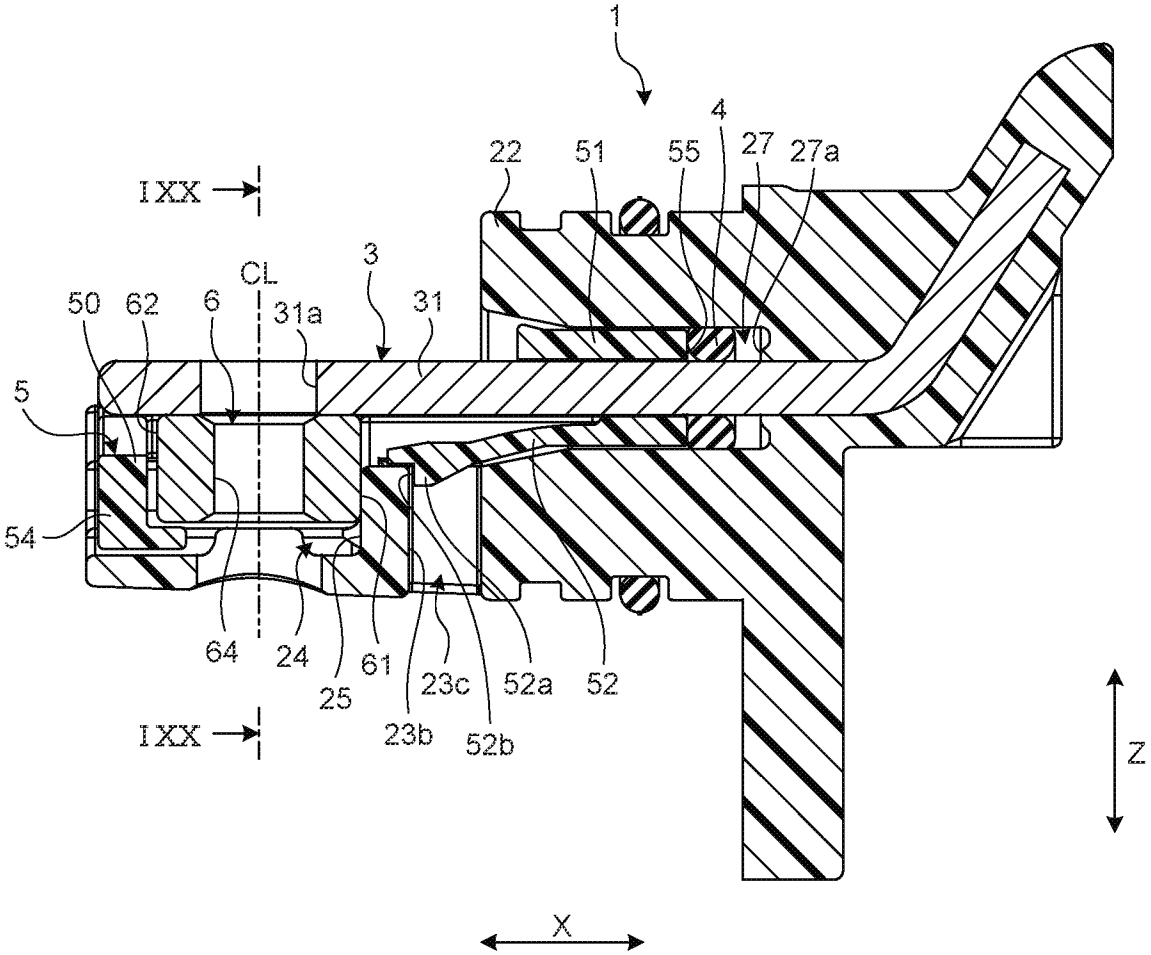
FIG. 18 is a cross-sectional view relating to an engagement process.
Figure 19:
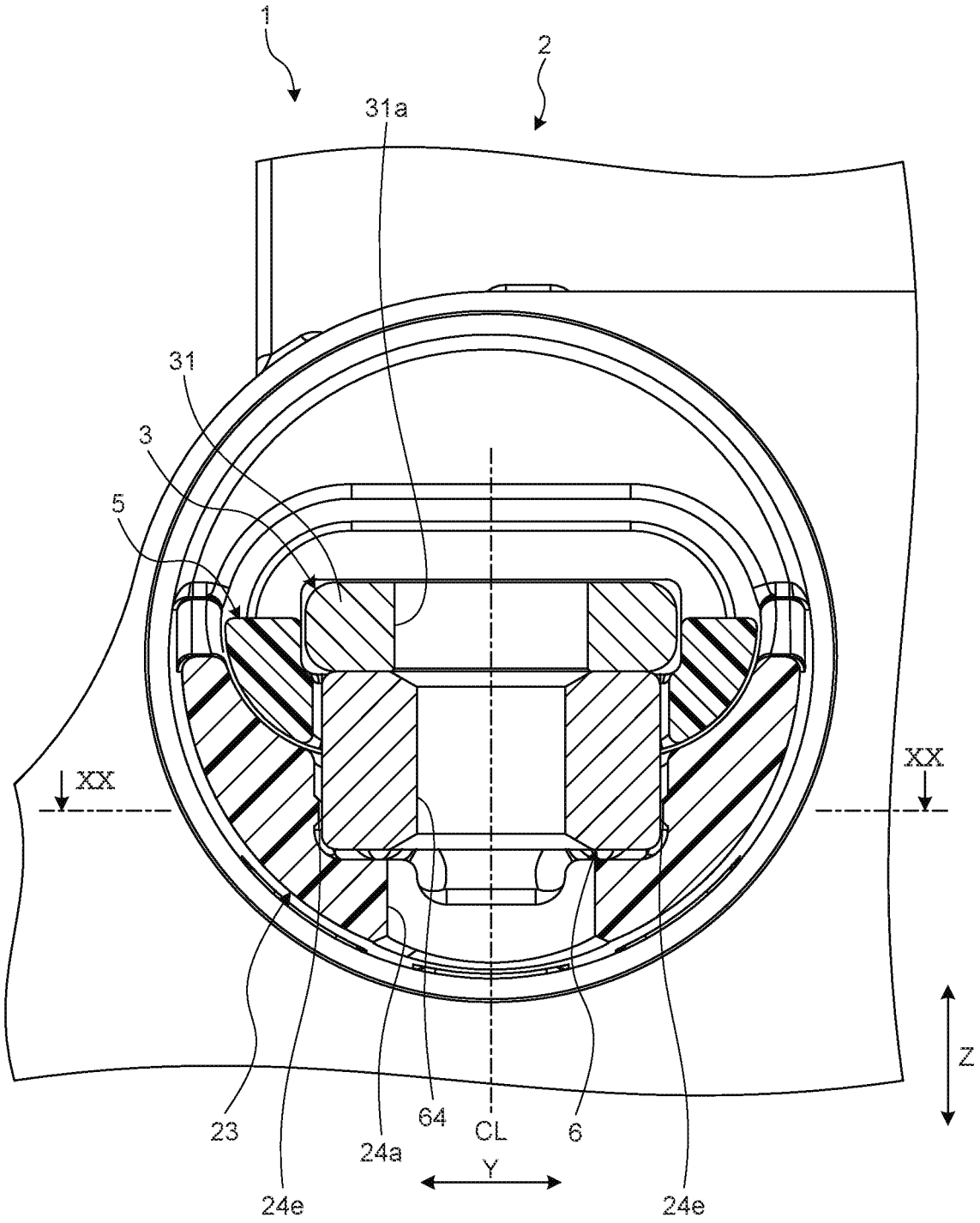
FIG. 19 is a cross-sectional view relating to a holding structure of the embodiment.
Figure 20:
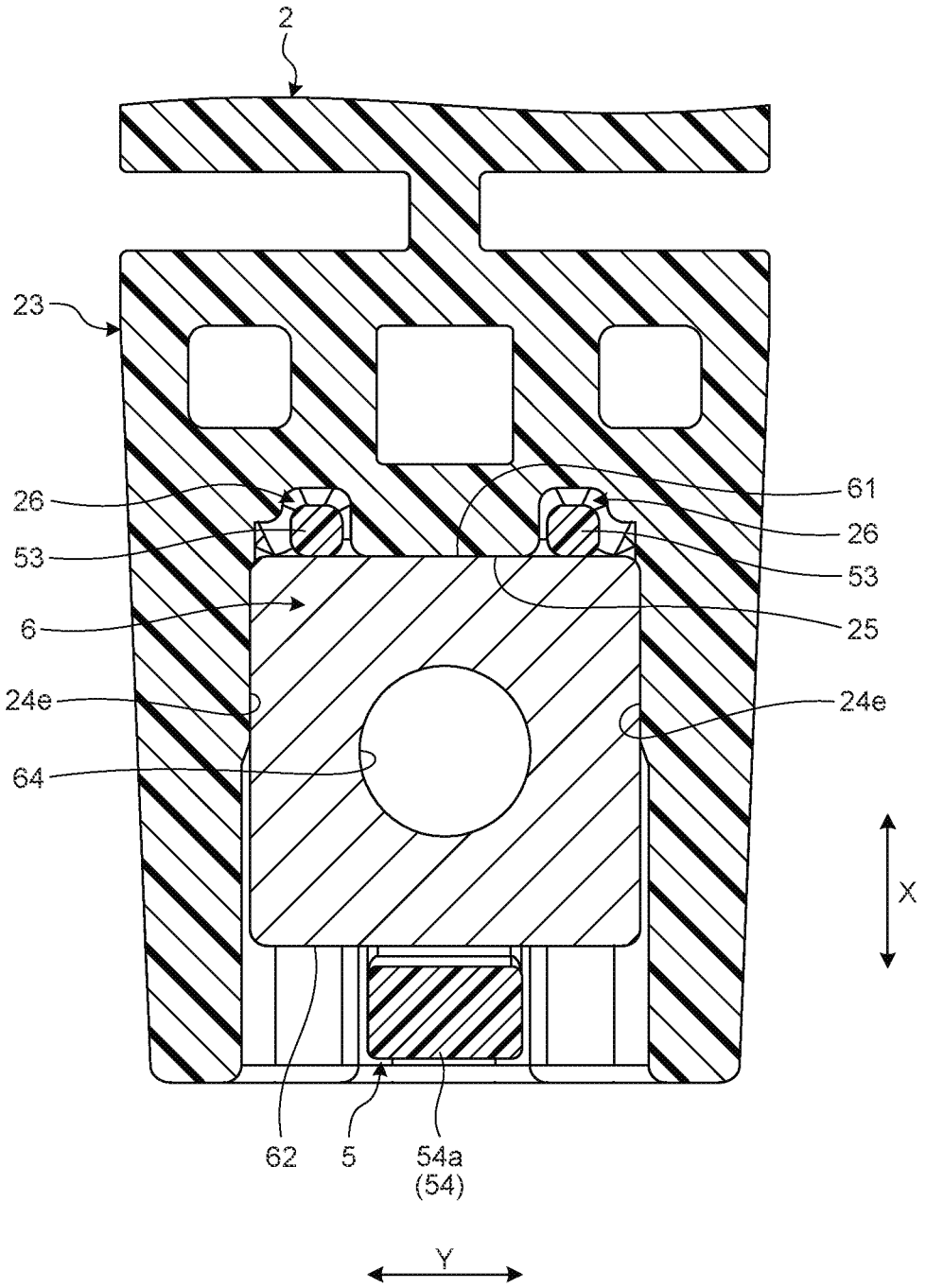
FIG. 20 is a cross-sectional view for explaining accommodation recesses according to the embodiment.
Figure 21:
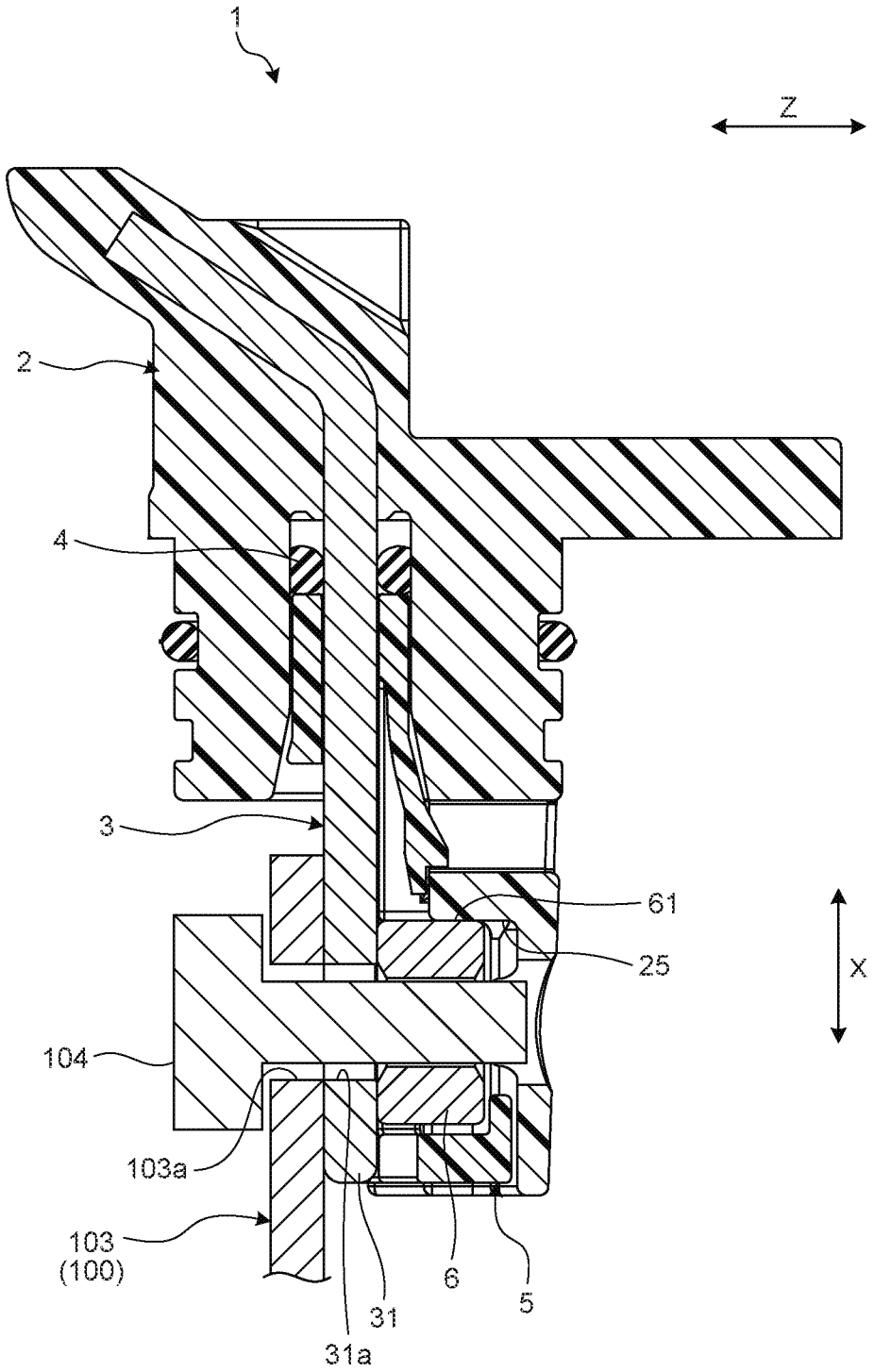
FIG. 21 is a cross-sectional view relating to a fastening process of the embodiment.

FIG. 11 is a perspective view of the support member and a nut according to the embodiment, FIG. 12 is a perspective view of the support member and the nut according to the embodiment, FIG. 13 is a perspective view of the support member and the nut according to the embodiment, FIG. 14 is a perspective view relating to a process of placing the nut, FIG. 15 is a perspective view relating to a first insertion process, FIG. 16 is a perspective view relating to a second insertion process, FIG. 17 is a cross-sectional view relating to a process of pushing-in a seal member, FIG. 18 is a cross-sectional view relating to an engagement process, FIG. 19 is a cross-sectional view relating to a holding structure of the embodiment, FIG. 20 is a cross-sectional view for explaining accommodation recesses according to the embodiment, and FIG. 21 is a cross-sectional view relating to a fastening process of the embodiment.

Figure 5:
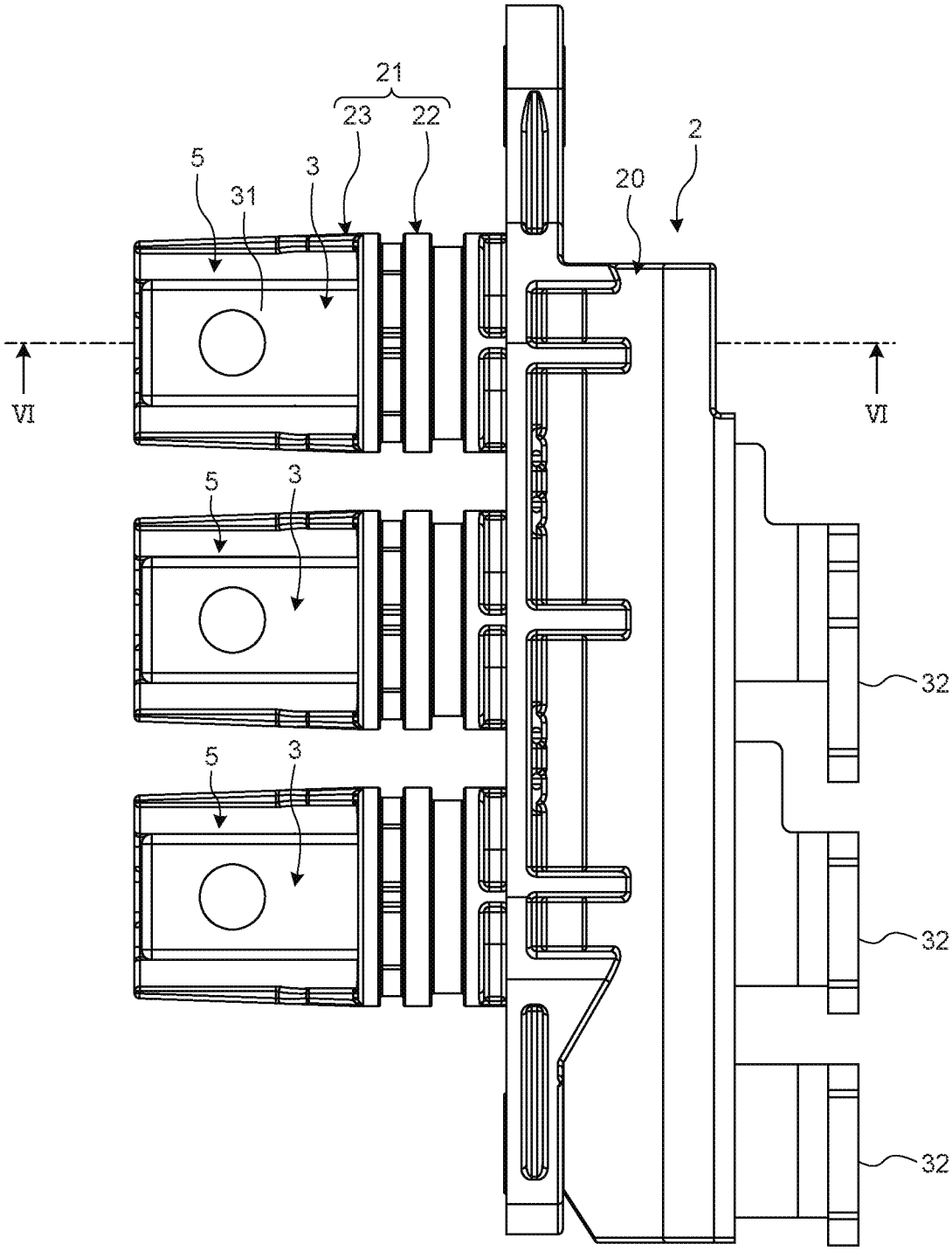
FIG. 5 is a plan view of a housing and the conductor according to the embodiment.
Figure 6:
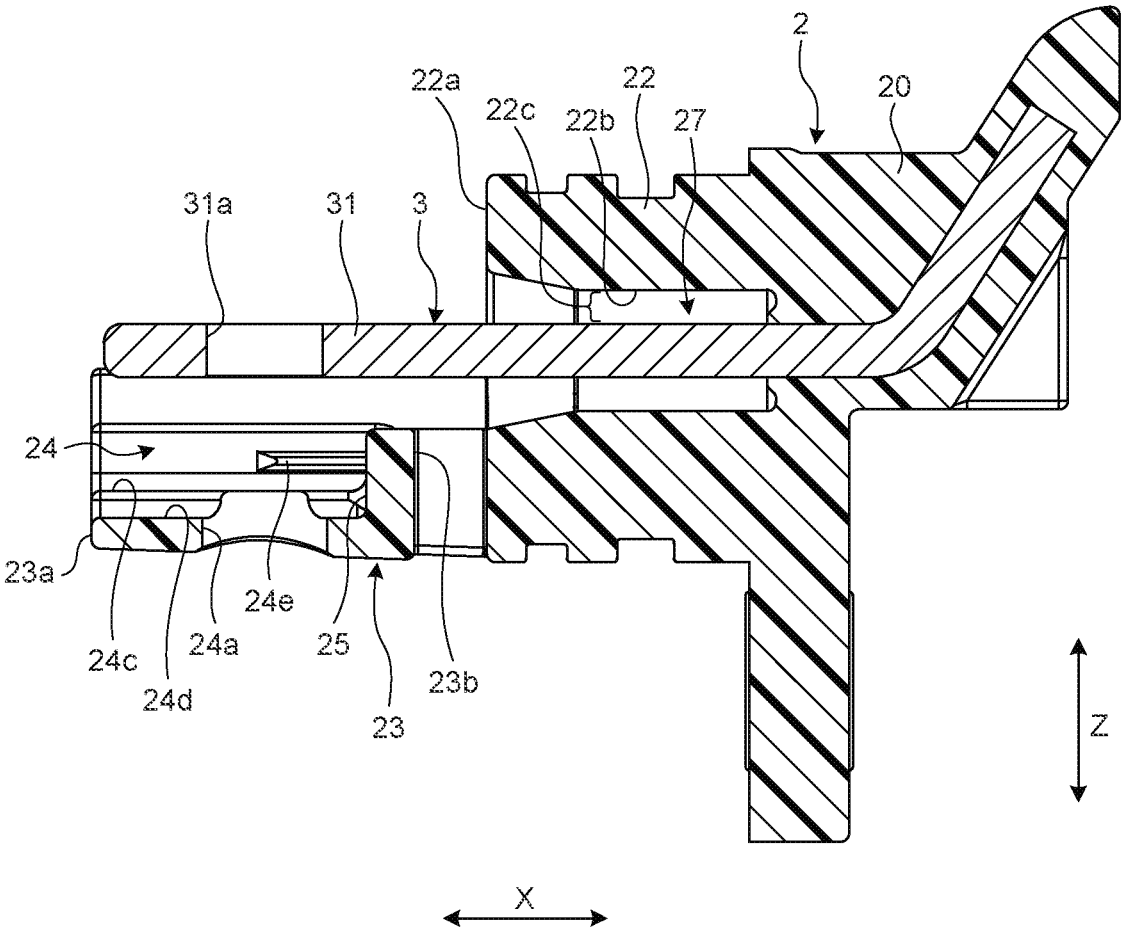
FIG. 6 is a cross-sectional view of the housing and the conductor according to the embodiment.

FIG. 6 illustrates a cross section taken along line VI-VI of FIG. 5. FIG. 8 illustrates a cross section taken along line VIII-VIII of FIG. 7. FIGS. 17 and 18 illustrate cross sections at the same position as FIG. 6. FIG. 19 illustrates a cross section taken along line IXX-IXX of FIG. 18. FIG. 20 illustrates a cross section taken along line XX-XX of FIG. 19.

As illustrated in FIG. 1, a connector 1 according to the present embodiment electrically connects a first device 100 and a second device 200 to each other. The first device 100 and the second device 200 are, for example, devices mounted on a vehicle. In the present embodiment, the first device 100 is a motor, and the second device 200 is an inverter. The first device 100 includes a case 101 and a motor main body 102. The second device 200 includes a case 201 and an inverter main body 202. An opening 101*a* is formed in an upper portion of the case 101. An opening 201*a* facing the opening 101*a* is formed in a lower portion of the case 201. The connector 1 is disposed in a communicating portion 10 where the opening 101*a* and the opening 201*a* communicate with each other. The connector 1 is fixed to, for example, the case 101 of the first device 100. A conductor 3 of the connector 1 has a first terminal portion 31 connected to the motor main body 102.

As illustrated in FIGS. 1 to 3, the connector 1 includes a housing 2, the conductor 3, a seal member 4, a support member 5, and a nut 6. In the present embodiment, the conductor 3, which is a plate-shaped metal conductor, is a so-called bus bar. The connector 1 includes, for example, a plurality of conductors 3. The seal member 4 is a packing that seals between the conductor 3 and the housing 2. The support member 5 is attached and fixed to the housing 2 in a state where the support member 5 holds the nut 6. The support member 5 has a function as a jig pushing-in the seal member 4 to a predetermined position.

As illustrated in FIG. 4, the conductor 3 includes the first terminal portion 31, a second terminal portion 32, and a second nut 33. The first terminal portion 31 is connected to the motor main body 102. The first terminal portion 31 has a rectangular flat plate shape. The first terminal portion 31 has a through hole 31*a* through which a fastening member such as a bolt is inserted. The through hole 31*a* is disposed, for example, in a distal end portion of the first terminal portion 31.

The second terminal portion 32 is connected to the inverter main body 202. The second terminal portion 32 has a flat plate shape. The conductor 3 as illustrated is bent between the first terminal portion 31 and the second terminal portion 32. The second nut 33 is fixed to the second terminal portion 32. A terminal of the inverter main body 202 is fastened together with the second terminal portion 32 by a fastening member such as a bolt.

In the following description, a direction in which the first terminal portion 31 extends will be referred to as "the first direction X". In addition, a width direction of the first terminal portion 31 will be referred to as "the second direction Y". In addition, a plate thickness direction of the first terminal portion 31 will be referred to as "the third direction Z". The first direction X, the second direction Y, and the third direction Z are orthogonal to each other. As illustrated in FIG. 1, etc., the plurality of conductors 3 are arranged in the second direction Y. The connector 1 is mounted on the vehicle, for example, so that the first terminal portion 31 extends in a vertical direction of the vehicle. In this case, the first terminal portion 31 protrudes downward from the housing 2.

The housing 2 is a member holding the conductor 3. The housing 2 is formed of, for example, an insulating synthetic resin. In the present embodiment, the housing 2 is integrally formed with the plurality of conductors 3. As illustrated in FIGS. 5 to 7, the housing 2 has a main body 20 and a protruding portion 21. The main body 20 and the protruding portion 21 are integrally formed. It should be noted that illustration of the conductor 3 is omitted in FIG. 7 to make it easy to understand the configuration of the protruding portion 21.

The main body 20 is a portion holding the conductor 3. The main body 20 is fixed to the case 101 of the first device 100 and supported by the case 101. The protruding portion 21 protrudes from the main body 20. The first terminal portion 31 is exposed to an external space from the main body 20 through the protruding portion 21. The second terminal portion 32 protrudes from the main body 20 in a direction opposite to the direction in which the protruding portion 21 protrudes. The housing 2 has one protruding portion 21 for one conductor 3.

As illustrated in FIGS. 5 to 7, the protruding portion 21 includes a cylindrical portion 22 and a holding portion 23. The cylindrical portion 22 is a proximal portion of the protruding portion 21. That is, the cylindrical portion 22 is connected to the main body 20. The cylindrical portion 22 has a cylindrical shape. As illustrated in FIG. 6, a proximal end of the cylindrical portion 22 is closed by the main body 20. The cylindrical portion 22 has a recess 27 surrounding the first terminal portion 31. The seal member 4 is pushed into the recess 27 to seal between the first terminal portion 31 and the housing 2.

The cylindrical portion 22 has a bottom, and is open only a side of the holding portion 23. When viewed in a cross section orthogonal to the first direction X, the cylindrical portion 22 has, for example, an oval shape. The cylindrical portion 22 surrounds a proximal portion of the first terminal portion 31. The distal end portion of the first terminal portion 31 protrudes from the cylindrical portion 22. An annular gap 22*c* is provided between an inner circumferential surface 22*b* of the cylindrical portion 22 and the first terminal portion 31 for the seal member 4 to be inserted thereinto.

The holding portion 23 protrudes from a distal end 22*a* of the cylindrical portion 22 in the first direction X. The holding portion 23 is configured to hold the nut 6, as will be described below. The holding portion 23 has a semi-cylindrical shape. The holding portion 23 has a holding recess 24 extending in the first direction X. The holding recess 24 is recessed in the first direction X from a distal end 23*a* of the holding portion 23 toward the cylindrical portion 22.

As illustrated in FIGS. 7 and 8, the holding recess 24 has an approximately rectangular cross-sectional shape. More specifically, the holding recess 24 has a pair of first wall surfaces 24*b* and 24*b* extending in the first direction X and a second wall surface 24*c* extending in the first direction X. The pair of first wall surfaces 24*b* and 24*b* faces each other in the second direction Y. The second wall surface 24*c* is a wall surface facing the third direction Z, and connects the pair of first wall surfaces 24*b* and 24*b* to each other. The pair of first wall surfaces 24*b* and 24*b* and the second wall surface 24*c* form a guide groove having an approximately rectangular cross-sectional shape. The holding recess 24 guides the support member 5 along the first direction X.

The second wall surface 24*c* is provided with a groove 24*d* extending in the first direction X. The groove 24*d* guides a second support piece 54 of the support member 5.

The holding recess 24 has a through hole 24*a*. The through hole 24*a* is disposed to be concentric with the through hole 31*a* of the conductor 3. The through hole 24*a* penetrates through a wall of the holding recess 24 in the third direction Z. The through hole 24*a* is open in the second wall surface 24*c*. An abutment surface 25 is provided deep in the first direction X in the holding recess 24. The abutment surface 25 is a position determining surface for determining a position of the nut 6 in the first direction X. The abutment surface 25 is a surface facing to the distal end 23*a* of the holding portion 23, and is, for example, orthogonal to the first direction X.

The holding portion 23 has accommodation recesses 26. The accommodation recesses 26 are adjacent to the abutment surface 25. The accommodation recesses 26 are portions accommodating first support pieces 53 of the support member 5. The accommodation recesses 26 are provided on both sides of the abutment surface 25 in the second direction Y, respectively. The accommodation recesses 26 are recessed with respect to the abutment surface 25 in the first direction X toward the cylindrical portion 22.

A linear rib 24*e* is provided on each of the pair of first wall surfaces 24*b* and 24*b*. The rib 24*e* is positioned deep in the first direction X on the first wall surface 24*b*. The rib 24*e* is a squashy rib extending in the first direction X. The rib 24*e* is squashed by the nut 6 when the nut 6 is press-fitted into the holding recess 24. The two ribs 24*e* face each other in the second direction Y.

As illustrated in FIG. 7, etc., the holding portion 23 has a locking surface 23*b* locking the support member 5. The locking surface 23*b* is positioned closer to the cylindrical portion 22 than the abutment surface 25. As illustrated in FIG. 6, the locking surface 23*b* is a wall surface in a through hole 23*c* positioned in the vicinity of the abutment surface 25. The through hole 23*c* penetrates through the holding portion 23 in the third direction Z.

As illustrated in FIGS. 9 to 13, the support member 5 includes a main body 50, an annular portion 51, a lock arm 52, a pair of first support pieces 53 and 53, and the second support piece 54. The main body 50, the annular portion 51, the lock arm 52, the first support pieces 53 and 53, and the second support piece 54 are integrally formed of, for example, an insulating synthetic resin. When viewed in a plan view, the main body 50 has a rectangular frame shape. The main body 50 has an opening 50*a* allowing the nut 6 to pass therethrough. The opening 50*a* has a rectangular shape.

The annular portion 51 is a portion configured to push the seal member 4 into the gap 22*c* between the housing 2 and the conductor 3 and support the seal member 4. The annular portion 51 protrudes from one side of the main body 50. The annular portion 51 has a through hole 51*a* through which the first terminal portion 31 is inserted. The annular portion 51 has a flat annular shape or a cylindrical shape. The through hole 51*a* has an elongated rectangular cross-sectional shape. A distal end surface of the annular portion is a support surface 55 pressing the seal member 4. The support surface 55 has an elongated annular shape corresponding to the shape of the seal member 4.

The first support pieces 53 and the second support piece 54 are piece portions supporting the nut 6. In the present embodiment, as illustrated in FIG. 11, the nut 6 is a quadrangular nut having a rectangular shape when viewed in a plan view. The first support pieces 53 are straight line-shaped piece portions supporting a first side surface 61 of the nut 6. The first side surface 61 is a side surface abutting against the abutment surface 25 of the housing 2. The first support pieces 53 protrude from a front end 50*b* of the opening 50*a* in the third direction Z. The front end 50*b* is an end portion located on a front side in an insertion direction when the support member 5 is inserted into the housing 2.

As illustrated in FIG. 12, the pair of first support pieces 53 and 53 are disposed to face end portions 61*a* and 61*a* of the first side surface 61. The end portions 61*a* are end portions of the first side surface 61 in the second direction Y. The first support pieces 53 support the end portions 61*a* of the first side surface 61. The pair of first support pieces 53 and 53 support the first side surface 61, with a central portion 61*b* of the first side surface 61 being exposed. The central portion 61*b* is a portion abutting against the abutment surface 25 of the housing 2. A length of the first support piece 53 corresponds to a thickness of the nut 6.

The second support piece 54 is a piece portion supporting a second side surface 62 and a main surface 63 of the nut 6. The second side surface 62 is a surface paired with the first side surface 61. The first side surface 61 and the second side surface 62 face opposite to each other. That is, the second side surface 62 is a surface facing to a side opposite to the abutment surface 25 side. The main surface 63 is one of surfaces in which a screw hole 64 has an opening.

The second support piece 54 protrudes from a rear end 50*c* of the opening 50*a*. The second support piece 54 is bent in an L shape. The second support piece 54 has a proximal end portion 54*a* connected to the main body 50 and a distal end portion 54*b*. The proximal end portion 54*a* protrudes from the main body 50 in the third direction Z. The distal end portion 54*b* protrudes from a distal end of the proximal end portion 54*a* in the first direction X. The proximal end portion 54*a* faces the second side surface 62 of the nut 6 in the first direction X and supports the second side surface 62. The distal end portion 54*b* faces the main surface 63 of the nut 6 in the third direction Z and supports the main surface 63.

As illustrated in FIG. 13, the proximal end portion 54*a* supports the nut 6, with at least a part of the second side surface 62 being exposed. More specifically, the proximal end portion 54*a* is configured to expose end portions 62*a* and 62*a* of the second side surface 62. That is, the proximal end portion 54*a* supports a central portion of the second side surface 62. In addition, the main body 50 of the support member 5 has a notch 56 exposing a central upper portion 62*b* of the second side surface 62. In other words, the second support piece 54 is disposed to expose the central upper portion 62*b* of the second side surface 62.

As illustrated in FIG. 9, etc., the lock arm 52 extends from the annular portion 51 toward the opening 50*a* along the first direction X. The lock arm 52 has flexibility, and thus can be flexurally deformed in the third direction Z. A protrusion 52*a* protruding in the third direction Z is provided at a distal end portion of the lock arm 52. The protrusion 52*a* has an opposing surface 52*b* locked by the locking surface 23*b* of the housing 2.

As illustrated in FIG. 3, etc., the seal member 4 has an annular shape. The seal member 4 as illustrated is formed in an oval shape so that the first terminal portion 31 of the conductor 3 can be inserted therethrough. The seal member 4 is formed of, for example, a resin such as rubber. The seal member 4 is inserted into the gap 22*c* between the housing 2 and the first terminal portion 31 to seal between the first terminal portion 31 and the housing 2.

A connector manufacturing method according to the present embodiment includes a process of placing the nut 6, a first insertion process, a second insertion process, a process of pushing-in the seal member 4, and a process of engaging the support member 5 with the housing 2.

In the process of placing the nut 6, the nut 6 is placed on the support member 5. More specifically, the nut 6 is inserted into the opening 50*a* of the support member 5 as illustrated in FIG. 14. The nut 6 is placed on the distal end portion 54*b* of the second support piece 54. The support member 5 supports the nut 6 using the pair of first support pieces 53 and 53 and the second support piece 54.

The process of placing the nut 6 is performed by, for example, an operator.

In the first insertion process, the conductor 3 held by the housing 2 is inserted through the annular seal member 4. More specifically, as illustrated in FIG. 15, the distal end portion of the first terminal portion 31 is inserted through the seal member 4. As indicated by arrow AR1 in FIG. 15, the first terminal portion 31 may be inserted through the seal member 4 by moving the seal member 4. The first insertion process is performed by, for example, an operator.

In the second insertion process, the conductor 3 is inserted into the annular portion 51 of the support member 5. More specifically, as illustrated in FIG. 16, the distal end portion of the first terminal portion 31 is inserted through the annular portion 51. The second insertion process is performed by, for example, an operator.

In the process of pushing-in the seal member 4, the seal member 4 is pushed into the recess 27 of the housing 2 by the annular portion 51 of the support member 5. As indicated by arrow AR2 in FIG. 17, the support surface 55 of the annular portion 51 pushes the seal member 4 into the recess 27. The seal member 4 is pushed into the gap 22*c* between the inner circumferential surface 22*b* of the recess 27 and the first terminal portion 31 while being compressed. The process of pushing-in the seal member 4 is performed by, for example, an operator.

In the process of engaging the support member 5 with the housing 2 (hereinafter, simply referred to as "the engagement process"), the support member 5 is engaged with the housing 2. In the engagement process, the support member 5 is pushed-in to a position where the protrusion 52*a* of the lock arm 52 is engaged with the through hole 23*c* of the housing 2. In FIG. 18, the support member 5 engaged with the housing 2 is illustrated. The lock arm 52 is engaged with the housing 2 by the protrusion 52*a*. The opposing surface 52*b* of the protrusion 52*a* faces the locking surface 23*b* of the housing 2. The locking surface 23*b* restricts the support member 5 from moving in a direction in which the support member 5 is likely to come out of the housing 2. The engagement process is performed by, for example, an operator.

The support member 5 engaged with the housing 2 restricts the nut 6 from escaping from the housing 2. The main body 50 and the second support piece 54 of the support member 5 face the second side surface 62 of the nut 6 in the first direction X. Accordingly, when the nut 6 moves in a direction in which the nut 6 comes out of the holding recess 24, the support member 5 can lock the nut 6 and restrict the movement of the nut 6.

The support member 5 supports the seal member 4 at a predetermined position using the annular portion 51. As illustrated in FIG. 18, the predetermined position is a position within the recess 27, and is a position before a bottom portion 27*a* of the recess 27. The bottom portion 27*a* is a deepest portion of the recess 27 in the first direction X. When the engagement of the support member 5 with the housing 2 is completed, the position of the seal member 4 in the first direction X is a predetermined position before the bottom portion 27*a* of the recess 27.

The annular portion 51 supports the seal member 4 in a state where there is a gap between the seal member 4 and the bottom portion 27*a*. The bottom portion 27*a* may have a burr generated when the housing 2 is formed. According to the connector manufacturing method according to the present embodiment, since the seal member 4 is not pushed up to the bottom portion 27*a*, a decrease in sealing performance of the seal member 4 is suppressed. In addition, since the seal member 4 is supported by the annular portion 51, a positional deviation of the seal member 4 is suppressed.

The annular portion 51 as illustrated is inserted into the gap 22*c* between the first terminal portion 31 and the inner circumferential surface 22*b*, thereby closing the gap 22*c*. Accordingly, the annular portion 51 can restrict entry of foreign matters into the recess 27.

In the connector 1 of the present embodiment, the nut 6 functions as a stopper for the support member 5. As illustrated in FIG. 18, the second side surface 62 of the nut 6 faces the second support piece 54 of the support member 5 in the first direction X. The second side surface 62 locks the second support piece 54 at a position illustrated in FIG. 18, when the support member 5 is further pushed-in toward the recess 27. The nut 6 can lock the support member 5 before the seal member 4 reaches the bottom portion 27*a* of the recess 27.

As described above, the connector manufacturing method according to the present embodiment includes the first insertion process, the second insertion process, the process of pushing-in the seal member 4, and the engagement process. The first insertion process is a process of inserting the conductor 3 held by the housing 2 through the annular seal member 4. The second insertion process is a process of inserting the conductor 3 through the annular portion 51 of the support member 5. In the process of pushing-in the seal member 4, the seal member 4 is pushed into the gap 22*c* between the inner circumferential surface 22*b* of the recess 27 and the conductor 3 by pressing the seal member 4 using the annular portion 51.

The engagement process is a process of making the annular portion 51 support the seal member 4 at the predetermined position by engaging the support member 5 and the housing 2. The predetermined position is a position before the bottom portion 27*a* of the recess 27. According to the connector manufacturing method according to the present embodiment, the seal member 4 can be positioned at an appropriate position before the bottom portion 27*a*. In addition, the annular portion 51 can prevent the seal member 4 from coming out.

In the present embodiment, the annular portion 51 has a shape allowing insertion thereof into the gap 22*c*. In the process of pushing-in the seal member 4, the annular portion 51 is inserted into the gap 22*c*. The annular portion 51 can suppress invasion of foreign matters into the recess 27.

The connector manufacturing method according to the present embodiment further includes a process of placing the nut 6 on the support member 5. In the process of pushing-in the seal member 4, the seal member 4 is pushed-in by the support member 5 supporting the nut 6. Then, the nut 6 is fixed to the housing 2 by the engagement process. The installation of the seal member 4 and the fixation of the nut 6 are performed simultaneously, thereby improving workability.

The connector 1 according to the present embodiment includes the conductor 3, the housing 2, the annular seal member 4, and the support member 5. The housing 2 holds the conductor 3 and has the recess 27 surrounding the conductor 3. The seal member 4 seals the gap 22*c* between the inner circumferential surface 22*b* of the recess 27 and the conductor 3. The support member 5 has the annular portion 51 positioned on an inlet side of the recess 27 with respect to the seal member 4. The support member 5 is engaged with the housing 2 in a state where the seal member 4 is supported by the annular portion 51. The seal member 4 is supported by the annular portion 51 at the position before the bottom portion 27*a* of the recess 27. In the connector 1 according to the present embodiment, the seal member 4 can be positioned at the appropriate position.

Modified Examples of Embodiment

The housing 2 may not be integrally formed with the conductor 3. In this case, the housing 2 preferably has a holding hole through which the conductor 3 is inserted. The conductor 3 is inserted through the holding hole of the housing 2 and held by the housing 2.

The shape of the conductor 3 is not limited to the plate shape as illustrated. The shape of the conductor 3 may be, for example, a rod shape such as a round rod. The support member 5 may be engaged with the housing 2 while supporting a member other than the nut 6. The support member 5 may be engaged with the housing 2 without supporting another member.

The contents disclosed in the embodiment and modified examples described above can be implemented in an appropriate combination.

A connector manufacturing method according to the embodiment includes: a process of pushing a seal member into a gap between an inner circumferential surface of a recess in a housing and a conductor by pressing the seal member using an annular portion; and an engagement process of making the annular portion support the seal member at a predetermined position by engaging a support member and the housing. The predetermined position is a position before a bottom portion of the recess. The connector manufacturing method according to the embodiment is advantageous in that the seal member can be positioned at an appropriate position before the bottom portion of the recess.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a conductor;

a housing holding the conductor and having a recess surrounding the conductor;

an annular seal member sealing a gap between an inner circumferential surface of the recess and the conductor;

a support member having an annular portion positioned on an inlet side of the recess with respect to the seal member, and engaged with the housing in a state where the seal member is supported by the annular portion, and a nut, wherein the seal member is supported by the annular portion at a position before a bottom portion of the recess, the support member has an opening into which the nut is inserted and a support piece that supports the nut inserted through the opening, the support member is engaged with the housing while the nut is supported by the support piece, and the nut prevents the support member from pushing the seal member to the bottom of the recess.

2. A connector manufacturing method comprising:

a first insertion process of inserting a conductor held by a housing through an annular seal member;

a process of placing a nut on a support member;

a second insertion process of inserting the conductor through an annular portion of the support member;

a pushing-in process of pushing the seal member into a gap between an inner circumferential surface of a recess in the housing and the conductor by pressing the seal member using the annular portion; and an engagement process of making the annular portion support the seal member at a predetermined position by engaging the support member and the housing, wherein the predetermined position is a position before a bottom portion of the recess, in the pushing-in process, the seal member is pushed-in by the support member supporting the nut, the nut is fixed to the housing by the engagement process, and the nut prevents the support member from pushing the seal member to the bottom of the recess.

3. The connector manufacturing method according to claim 1, wherein the annular portion has a shape allowing insertion thereof into the gap, and in the pushing-in process, the annular portion is inserted into the gap.

* * * * *